US007707866B2

(12) United States Patent
Lanterman et al.

(10) Patent No.: US 7,707,866 B2
(45) Date of Patent: May 4, 2010

(54) DIE SEPARATOR CYLINDER

(75) Inventors: Harold I. Lanterman, Stow, OH (US); Henry J. Kelm, Litchfield, OH (US); Terry L. Gang, Jr., Uniontown, OH (US); Steven J. Reilly, Westlake, OH (US)

(73) Assignee: Barnes Group Inc., Bristol, CT (US)

( * ) Notice: Subject to any disclaimer, the term of this patent is extended or adjusted under 35 U.S.C. 154(b) by 479 days.

(21) Appl. No.: 11/637,486

(22) Filed: Dec. 12, 2006

(65) Prior Publication Data

US 2007/0151699 A1 Jul. 5, 2007

Related U.S. Application Data

(60) Provisional application No. 60/750,032, filed on Dec. 13, 2005.

(51) Int. Cl.
*B21D 22/00* (2006.01)
*B21D 24/08* (2006.01)
*B21J 9/18* (2006.01)

(52) U.S. Cl. ..... 72/351; 72/453.01; 72/453.18

(58) Field of Classification Search ..... 72/350–351, 72/453.01, 453.13, 453.18; 267/199, 130, 267/119, 120
See application file for complete search history.

(56) References Cited

U.S. PATENT DOCUMENTS 5,172,892 A 12/1992 Wallis
6,022,004 A 2/2000 Kelm et al.
6,170,809 B1 1/2001 Cotter
6,390,457 B1 * 5/2002 Roper ..... 267/119
6,749,185 B1 6/2004 Reilly et al.
6,796,159 B2 9/2004 Kelm et al.
6,978,799 B2 * 12/2005 Kugelev et al. ..... 137/514.7
2004/0182442 A1 * 9/2004 Frampton et al. ..... 137/460
2005/0205681 A1 9/2005 Ord et al.

OTHER PUBLICATIONS

Brochure titled "*Tanker XP Series*", Hyson Products 1999, 1199TXP2.5M.

International Search Report for International application No. PCT/US2006/47230.

Written Opinion of the International Searching Authority for International application No. PCT/US2006/47230.

* cited by examiner

*Primary Examiner*—Dana Ross
*Assistant Examiner*—Mohammad Yusuf
(74) *Attorney, Agent, or Firm*—Fay Sharpe LLP

(57) ABSTRACT

A die separator cylinder for use in separating first and second portions of a metal forming die set comprises a housing including a bore. A piston is adapted to reciprocate in the bore between an extended position and a depressed position. The die separator cylinder further includes gas flow paths leading to and from the bore that define asymmetrical gas flow rates relative to each other so that said when the bore is charged with an inert gas, the inert gas biases the piston to the extended position with a force that varies depending upon a time interval elapsed since the piston moved from the depressed position to the extended position. As such, the cylinder is configured so that during opening and closing of the press for metal-forming operations, the piston moves inward and outward with reduced force, while during periods of inactivity, the piston is biased outward with maximum force sufficient to separate the die halves of the die set to protect the die surfaces and to facilitate stacking of the die set for storage. The die separator cylinder can be configured as a stand-alone self-contained cylinder or can be configured as part of a hosed system or the like.

18 Claims, 8 Drawing Sheets

DIE SEPARATOR CYLINDER

CROSS REFERENCE TO RELATED APPLICATION

This application claims priority from and benefit of the filing date of U.S. provisional application Ser. No. 60/750,032 filed Dec. 13, 2005, the disclosure of which is hereby incorporated by reference.

BACKGROUND

Gas springs charged with nitrogen or other inert gas are well-known and in widespread use in connection with metal-forming die sets. Examples of such nitrogen gas springs are disclosed in U.S. Pat. No. 6,022,004 entitled "Self-Lubricating Fluid Cylinder," U.S. Pat. No. 6,749,185 entitled "Cushion Assembly and Method," and U.S. Pat. No. 6,796,159 entitled "Low Contact Force Spring," all of which patents are hereby incorporated by reference. These gas springs and others are available commercially from Hyson Products, Brecksville, Ohio, U.S.A.

A need has been identified for a new type of gas spring to be used as a die separator cylinder. More particularly, a need has been found for a die separator cylinder, a group of which is adapted to be assembled into a forming die set which is used in a press, wherein the die separator cylinders provide maximum separation force to maintain the upper and lower die components in a spaced-apart relationship when the die set is put into storage, and wherein the die separator cylinder provide minimal separation force when the die set is put into use so as to have minimal effect on metal forming operations.

SUMMARY

In accordance with one aspect of the present development, a die separator cylinder for use in separating first and second portions of a metal forming die set comprises a housing including a bore. A piston is adapted to reciprocate in the bore between an extended position and a depressed position. The die separator cylinder further includes gas flow paths leading to and from the bore that define asymmetrical gas flow rates relative to each other so that said when the bore is charged with an inert gas, the inert gas biases the piston to the extended position with a force that varies depending upon a time interval elapsed since the piston moved from the depressed position to the extended position.

In accordance with another aspect of the present development, a method for operating a pressurized gas cylinder in a metal forming die set includes securing a body of a pressurized gas cylinder to a first portion of a metal forming die set. A piston of said pressurized gas cylinder is biased to an extended position in a bore of the body by pressurized gas contained in the bore so that a piston rod connected to the piston projects outwardly away from the cylinder body. A force is applied to the piston rod with a second portion of the metal forming die set to move the piston from the extended position in the bore to a depressed position in the bore, wherein gas is displaced from the bore to a gas containment space by a bore outflow path in a first time period when the piston moves from the extended position in the bore to the depressed position. The force is removed to allow the piston to move from the depressed position in the bore to the extended position in the bore in response to gas pressure remaining in the bore. Gas is flowed from the gas-containment space to the bore by way of a bore inflow path so that equilibrium pressure is reached between the bore and the gas-containment space in a second time period, wherein the bore inflow path is restricted as compared to the bore outflow path so that the second time period to reach equilibrium is longer than the first time period.

DETAILED DESCRIPTION

Figure 1B:
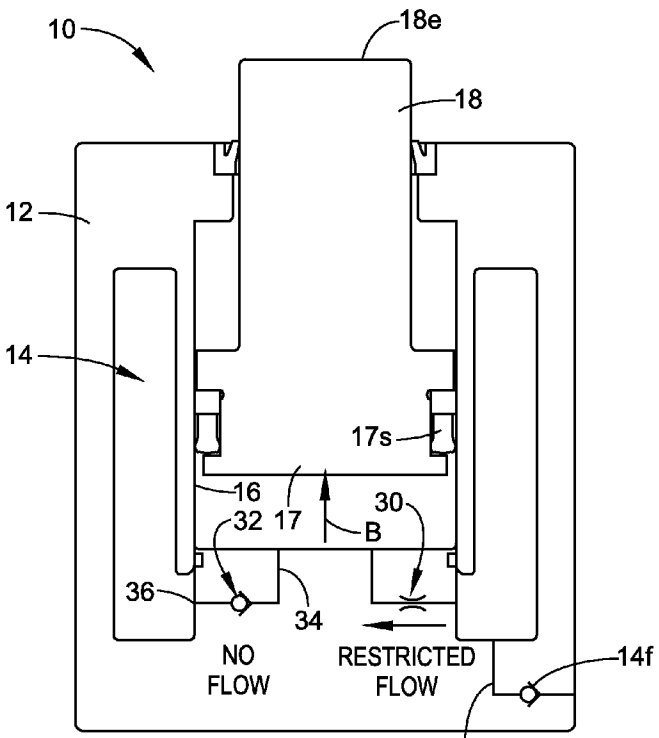
FIGS. 1A and 1B schematically illustrate a die separator cylinder 10 formed in accordance with the present development.
Figure 1A:
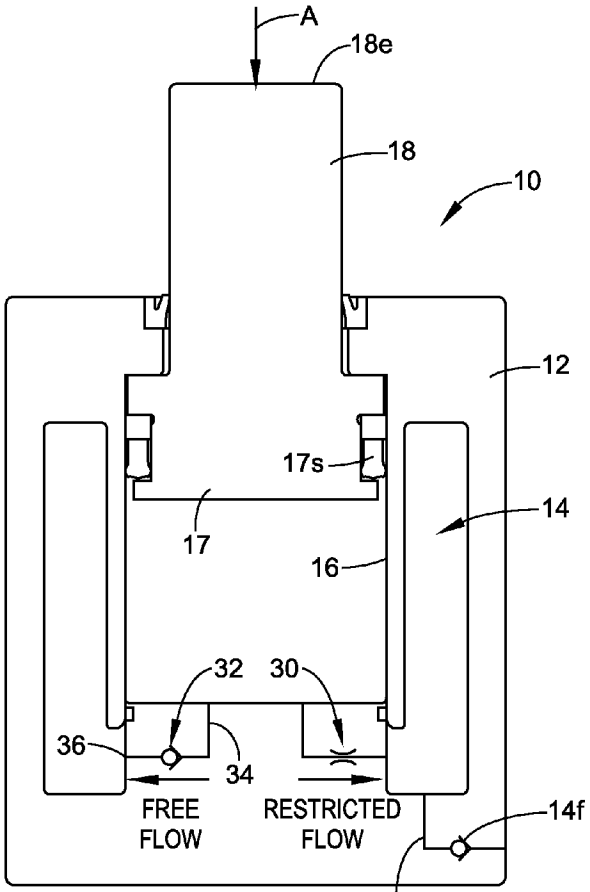

FIGS. 1A and 1B schematically illustrate a die separator cylinder 10 formed in accordance with the present development. The cylinder 10 comprises a body 12 defining a gas-containment space 14 and a bore 16 in which a piston 17 is closely slidably fitted for reciprocal axial movement between an extended position (shown in FIG. 1A) and a retracted or depressed position (such as that shown FIG. 1B or another position where the piston 17 is moved inward from the extended position of FIG. 1A). A piston rod 18 is connected as a one-piece construction or otherwise to the piston 17 and moves with the piston, while an outer end 18*e* of the rod projects outwardly from the bore 16. A seal 17*s* blocks escape of gas between the piston 17 and the wall defining the cylinder bore 16. The piston 17 is biased outward to an extended position as shown in FIG. 1A under force of pressurized gas, typically nitrogen or another inert gas, contained in the space 14, which is in communication with the bore 16 by a restricted bore inflow passage 30 (sometimes referred to herein as a bleed orifice 30). The gas is charged in the space 14 through a fill fitting 14*f* and fill passage 14*g*.

When the piston 17 is moved from the extended position shown in FIG. 1A inward to a depressed position such as that shown in FIG. 1B by application of an external force A to the outer end 18*e* of rod 18, as when the die set is used to form a part, gas in the bore 16 is displaced from the bore 16 to the gas-containment space 14 primarily through a bore outflow path 34 comprising one or more check valves 32 located fluidically between the gas-containment space 14 and the bore 16 (a very small amount of gas is also displaced through the bleed orifice 30 which is very restricted as described below). The bore outflow path 34 communicates with the gas-containment space 14 via port 36. The gas pressure in both the bore 16 and gas-containment spaces rises when the piston 17 is depressed.

When the external force A applied to the piston rod 18 abates, as shown in FIG. 1B, the piston 17 is biased outward to the fully extended position by the pressurized gas remaining in the bore 16 and also by gas that flows (very slowly as described below) from the gas-containing space 14 into the bore 16 through the bleed orifice 30. The check valve 32 preferably completely blocks or at least substantially blocks return flow of gas from the gas-containment space 14 to the cylinder bore 16 by way of the bore outflow path 34 (some leakage around the check valve 32 is contemplated and deemed to be within the scope and intent of the present development). Those of ordinary skill in the art will recognize that, owing to the bleed orifice 30 being the only return flow path (or primary return flow path if any minimal leakage through the check valve(s) occurs) for the displaced biasing gas to return to the cylinder bore 16 from the gas-containment space 14, an extended period of time (several minutes or more) will be required before equilibrium gas pressure between these two volumes 16,14 is achieved (although the piston rod 18 will be biased outward to its fully extended position as shown in FIG. 1A nonetheless by the reduced pressure gas that remains in the bore 16). As such, when the external force A (FIG. 1A) is reapplied to the piston rod 18 before equilibrium gas pressure is reached between the piston cylinder bore 16 and the gas-containment space 14, the piston rod 18 will move inward with much less resistance force as compared to the previous stroke, and any gas that returned to the cylinder bore 16 through the bleed orifice 30 will again be displaced to the gas-containment space 14 through the check valve(s) 32 (and also very little through the orifice 30). This reduced-force condition will be maintained for as long as the cylinder is repeatedly stroke at an interval that is less than the time required for equilibrium between the gas volumes 14,16 to be reached.

Those of ordinary skill in the art will recognize that a die separator cylinder formed in accordance with the present development comprises gas flow paths 30,34 leading to and from the bore 16 that define asymmetrical gas flow rates relative to each other so that the inert gas with which the bore is charged biases the piston 17 to its extended position with a force that varies depending upon the time elapsed since the piston moved from a depressed position to the extended position.

Figure 2:
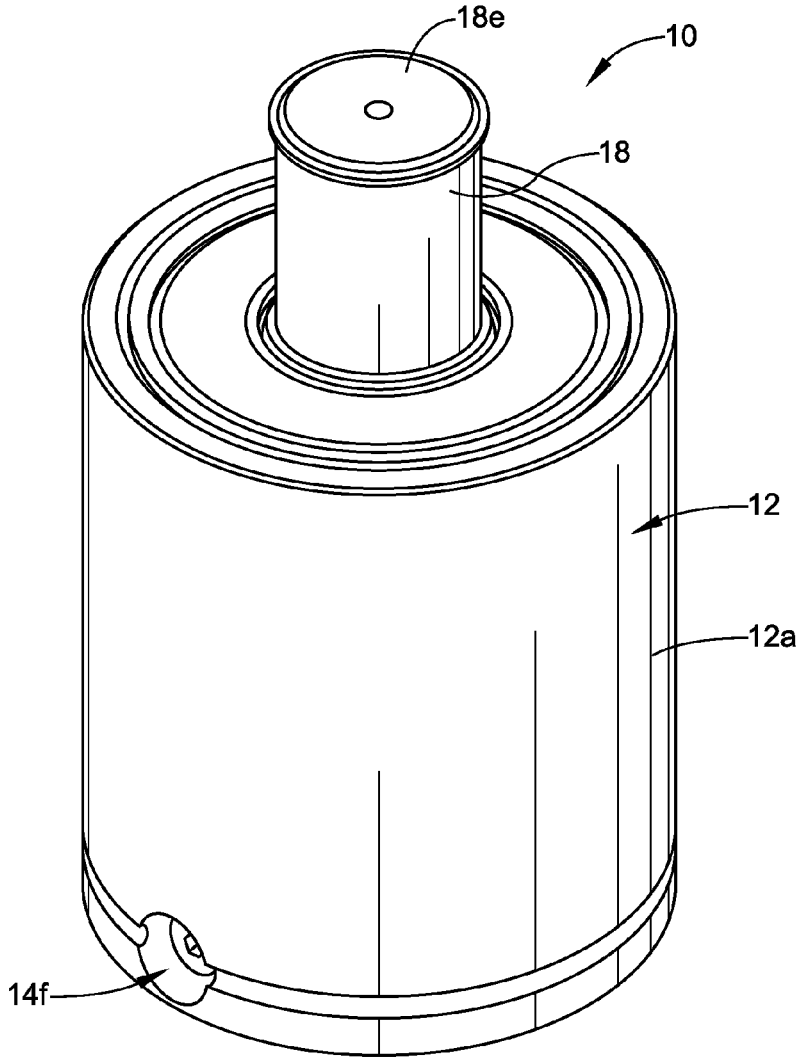
FIG. 2 is an isometric view of a die separator cylinder formed in accordance with the present development.
Figure 2B:
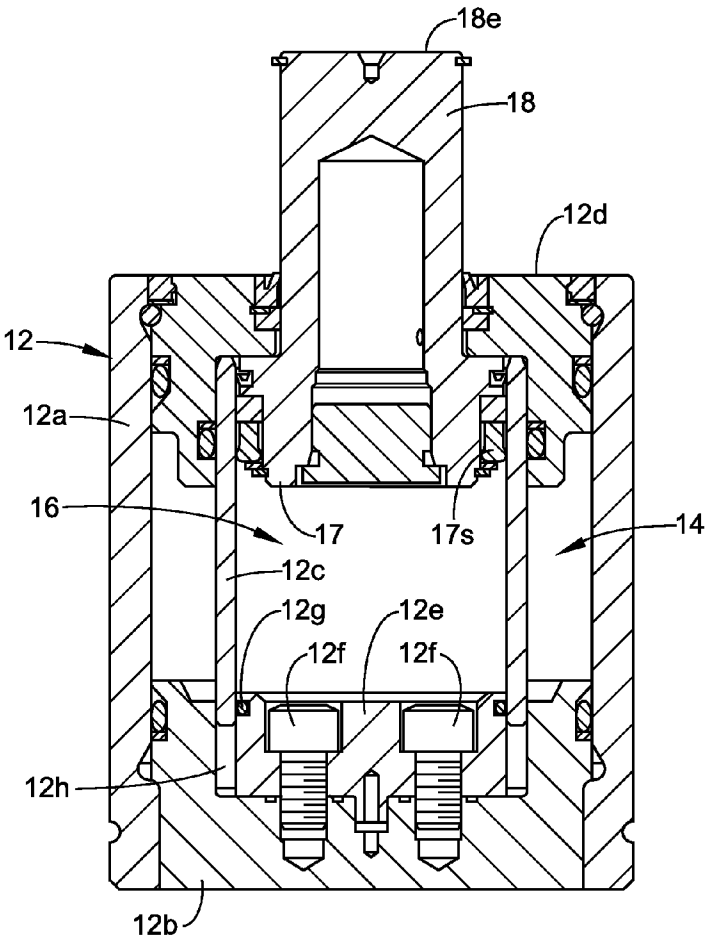
FIGS. 2A and 2B show first and second sectional views of an embodiment of the die separator cylinder 10 formed in accordance with the present development.
Figure 2A:
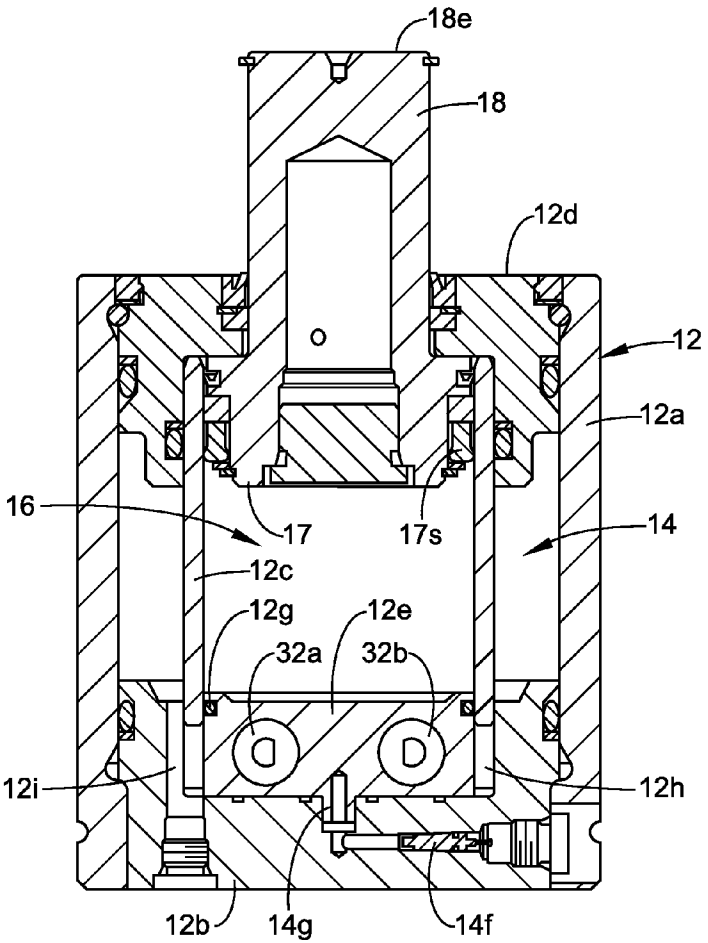

FIG. 2 is an isometric view of a die separator cylinder 10 formed in accordance with the present development, and FIGS. 2A and 2B show first and second sectional views of the die separator cylinder 10. As described above with reference to the schematic drawings of FIGS. 1A and 1B, the cylinder 10 comprises a body 12 defining a gas-containment space 14 and a bore 16 in which a piston 17 is closely slidably fitted for reciprocal axial movement. A seal 17*s* blocks escape of gas between the piston 17 and the wall defining the cylinder bore 16. The piston 17 is biased outward to an extended position as shown in FIGS. 2A and 2B under force of pressurized gas, typically nitrogen, contained in the space 14, which is in communication with the bore 16 by the bleed orifice 30. The gas is charged in the space 14 through a fill fitting 14*f*. As shown, the cylinder body 12 comprises an outer housing 12*a* to which a base 12*b* is connected. A cylindrical wall member 12*c* that defines the bore 16 and that separates the bore 16 from the gas-containment space 14 is supported adjacent the base 12*b* and cooperates with the outer housing to define the gas-containment space 14. The piston 17 is fitted in the bore 16 with a seal 17*s* (along with various wipers, spacers, etc. as shown and as known in the art) and a bonnet or end-cap 12*d* is connected to outer housing 12*a* and captures the various components in the outer housing 12*a*. The wall 12*c* can be supported on the base 12*b* and/or connected to the end-cap 12*d*, e.g., with a tight friction fit.

A delay plug 12*e* is located in the bore 16 and connected to the base 12*b* by fasteners 12*f* (FIGS. 2B & 3) and is sealed to the wall member 12*c* by an o-ring seal 12*g* and thus blocks flow of gas between the gas-containment space 14 and the bore 16 at this interface. An annular space 12*h* is defined between the plug 12*e* and the base 12*b* (note that the wall 12*c* is prevented from moving axially into the annular space 12*h* by its engagement with the end-cap 12*d* and/or otherwise, e.g., by abutment with the base 12*b*, itself. The annular space 12*h* is in fluid communication with the gas-containment space 14 only at least one axially extending flow port 12*i*. The fill fitting 14*f* is shown in FIG. 2A and communicates with the annular space 12*h* through a fill passage 14*g* (the passage 14*g* is only partially visible in FIG. 2A due to the orientation of the sectional view).

As described above, the die separator defines at least one or more bore outflow paths 34 each comprising a check valve 32. As shown herein, the delay plug 12*e* defines two separate bore outflow, paths 34*a*,34*b* including respective check valves 32*a*,32*b* that provides one-way fluid communication from the cylinder bore 16 to the annular space 12*h* and, thus, to the gas-containment space 14 via flow port 12*i*. As described above, the check valves 32*a*,32*b* block flow in the reverse direction from gas-containment space 14 to cylinder bore 16 via paths 34*a*,34*b* (the term "block" as used herein contemplates full blockage or substantial blockage of gas flow through the paths 34*a*,34*b*).

Figure 3:
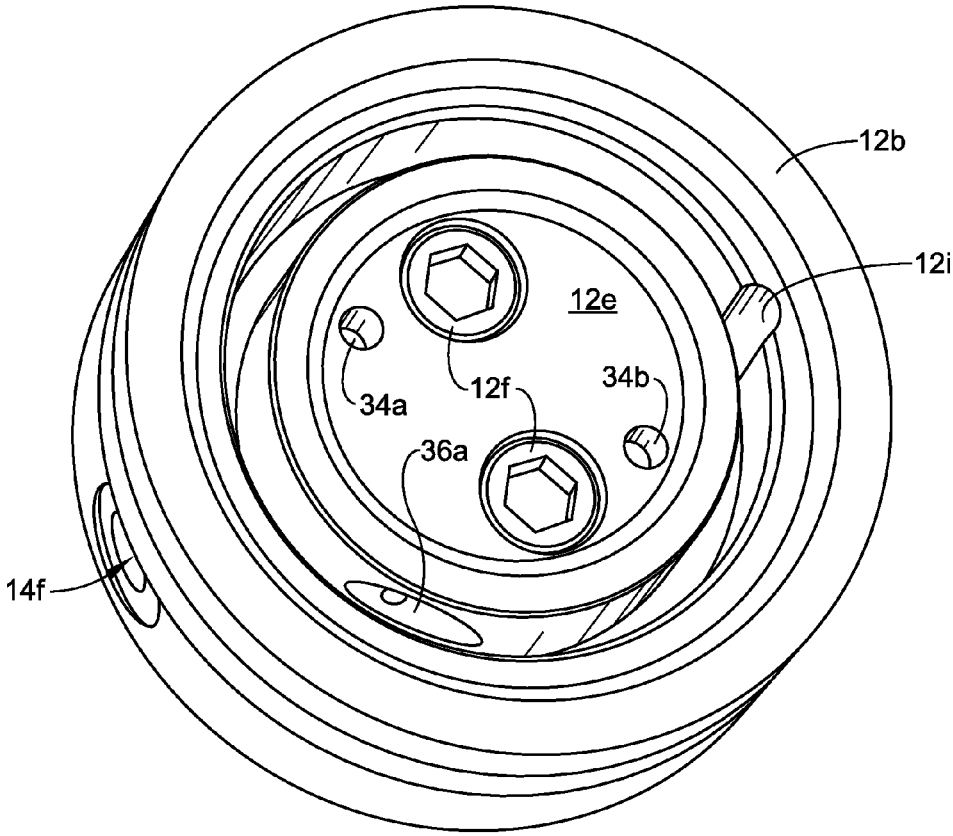
FIG. 3 shows a delay plug and base subassembly of the die separator cylinder of FIG. 1.
Figure 4:
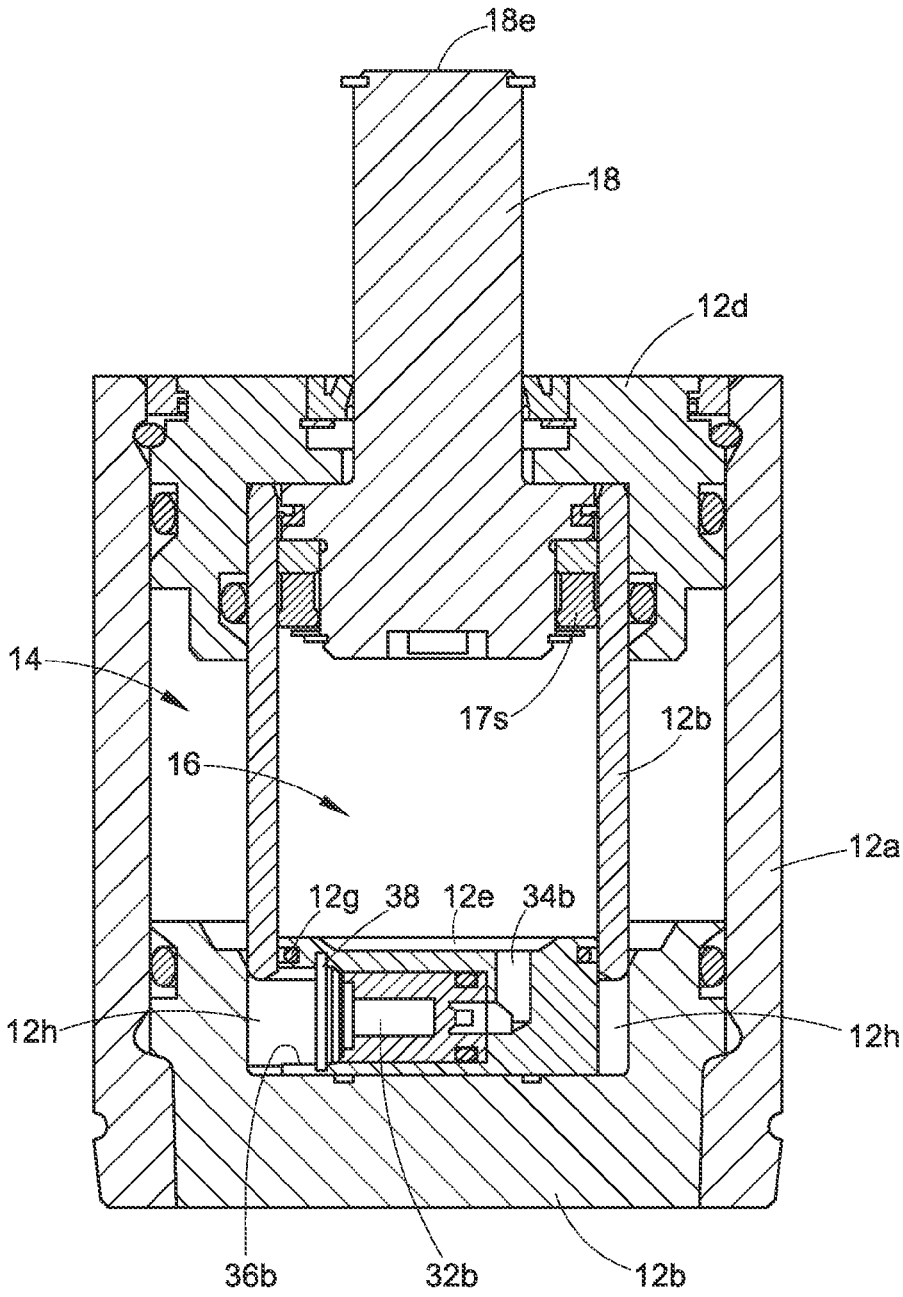
FIG. 4 is another sectional view of the die separator cylinder of FIG. 1.

FIG. 3 shows the subassembly of the delay plug 12*e* fastened to the base 12*b*. There, it can be seen that passages 34*a*,34*b* are provided to communicate gas from the cylinder bore 16 to the check valves 32*a*,32*b*, respectively. Also, the annular space 12*h* and axial flow passage 12*i* are shown. A port 36*a* for check valve 32*a* to communicate with the annular passage 12*h* is also visible (the port 36*b* for the check valve 32*b* to communicate with the annular passage 12*h* is identical but not visible—see FIG. 4). FIG. 4 shows the check valve 32*b* installed in the delay plug 12*e* using a rolled pin 38 (the check valve 32*a* is identically or similarly installed).

Figure 5:
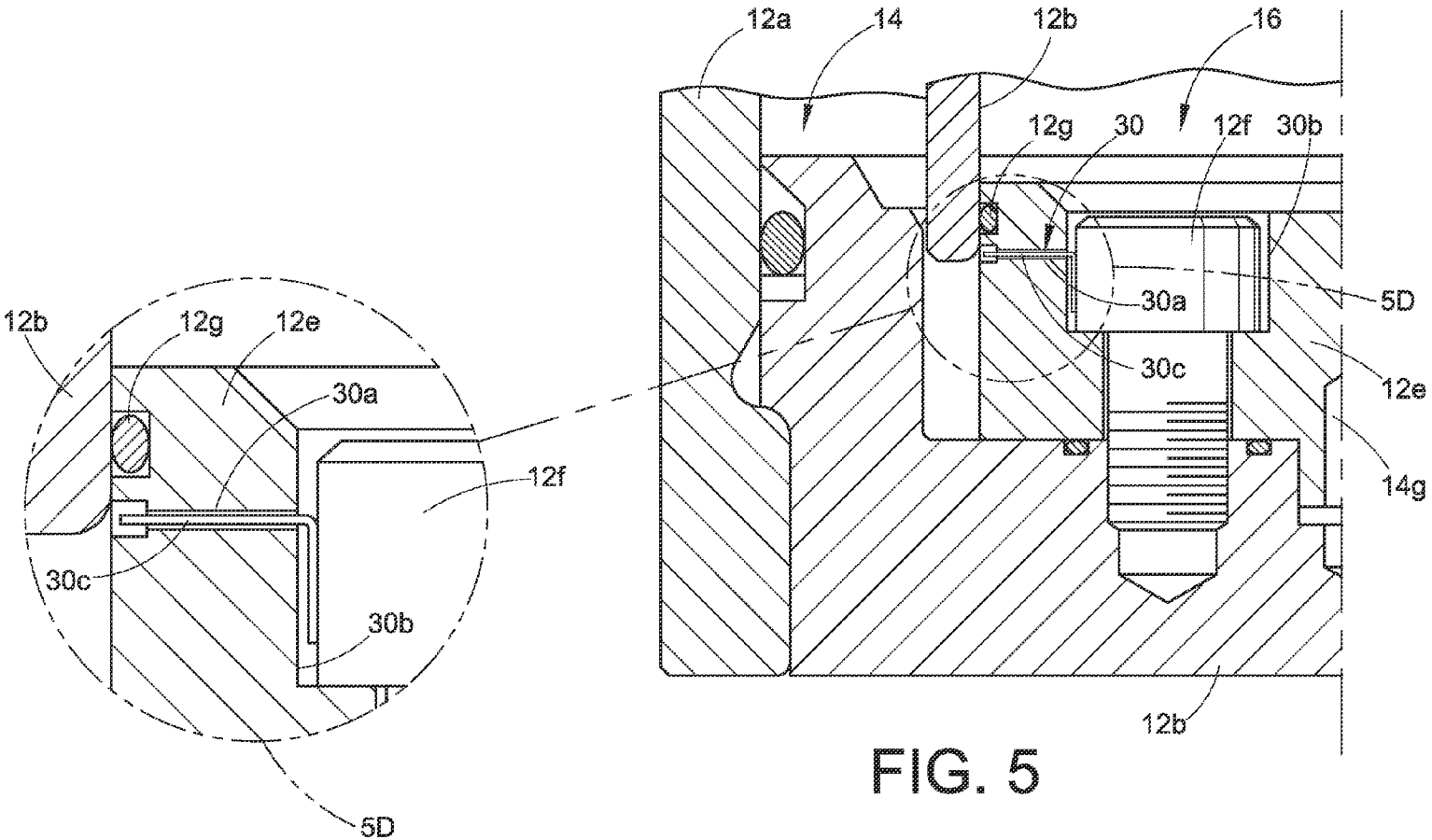
FIG. 5 is an enlarged partial sectional view of the die separator cylinder of FIG. 1 that shows the bleed orifice, which is greatly enlarged in a detail view.

FIG. 5 is a partial sectional view of the cylinder 10 that shows the bleed orifice 30 that provides a very restricted flow path between the annular space 12*h* and the cylinder 16. As shown herein, the bleed orifice comprises a tiny bore 30*a* that extends through the delay plug 12*e*, in particular, from an outer peripheral wall of the delay plug in communication with annular space 12*h* to a counterbore 30*b* for one of the fasteners 12*f* which communicates with the cylinder bore 16. To further restrict the bleed orifice, if needed, a wire 30*c* or other occlusion is inserted/installed in the bore 30*a* and bent as shown so that the wire is trapped by the fastener 12*f*, in which case the only gas flow through the bore 30*a* must occur in a small space between the bore 30*a* and the wire 30*c*. Detail 5D provides a greatly enlarged view.

Figure 6:
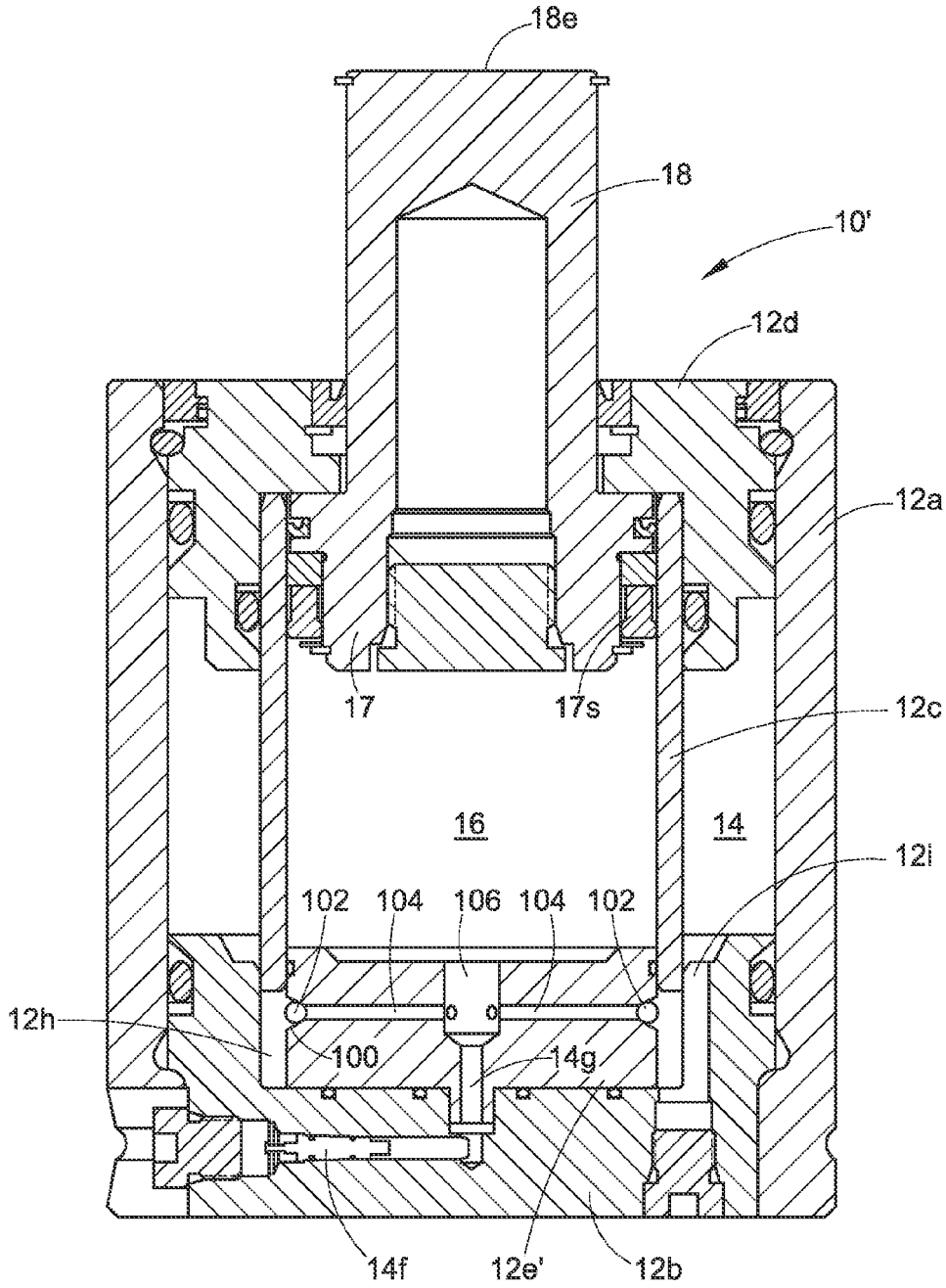
FIG. 6 illustrates an alternative die separator cylinder formed in accordance with the present development; and, FIG. 7 is a graph that illustrates operational principles of a die separation cylinder formed in accordance with the present development.

FIG. 6 illustrates an alternative cylinder 10 that accomplishes the same result as the cylinder 10, in a slightly different fashion. The delay plug 12*e*' comprises an annular groove 100 in which an o-ring seal 102 is tightly seated. One or more flow passages 104 intersect the annular groove 100 and also communicate with the cylinder bore 16 through a central distributor bore 106 (the fill passage 14*g* also communicates with the cylinder bore 16 through the distributor bore 106). In use, as the piston 17 is depressed toward the delay plug 12*e*' and the gas in the cylinder bore 16 is compressed, the gas is urged into distributor bore 106 and the flow passages 104 of the delay plug 106' and moves radially outward toward the annular space 12*h* that is defined between the delay plug 12*e*' and the base 12*b*. The o-ring 102 expands radially outward in the groove 100 under force of the gas flowing in the flow passage 104 so that the gas can flow past the o-ring 102 into the annular space 12*h* and from there into the gas-containment space 14 through the axial flow passage 12*i*. When the piston rod 18 is allowed to return to the extended position, the o-ring 102 acts as a check valve to block return flow of the gas to the cylinder bore 16. A bleed orifice 30 (not shown in FIG. 6) as described above is included in the delay plug 12*e*' for restricted return flow of the gas or, optionally, the bleed path is provided by small imperfections in the seal between the o-ring 102 and the groove 100 to provide a restricted return flow path for the displaced gas.

Figure 7:
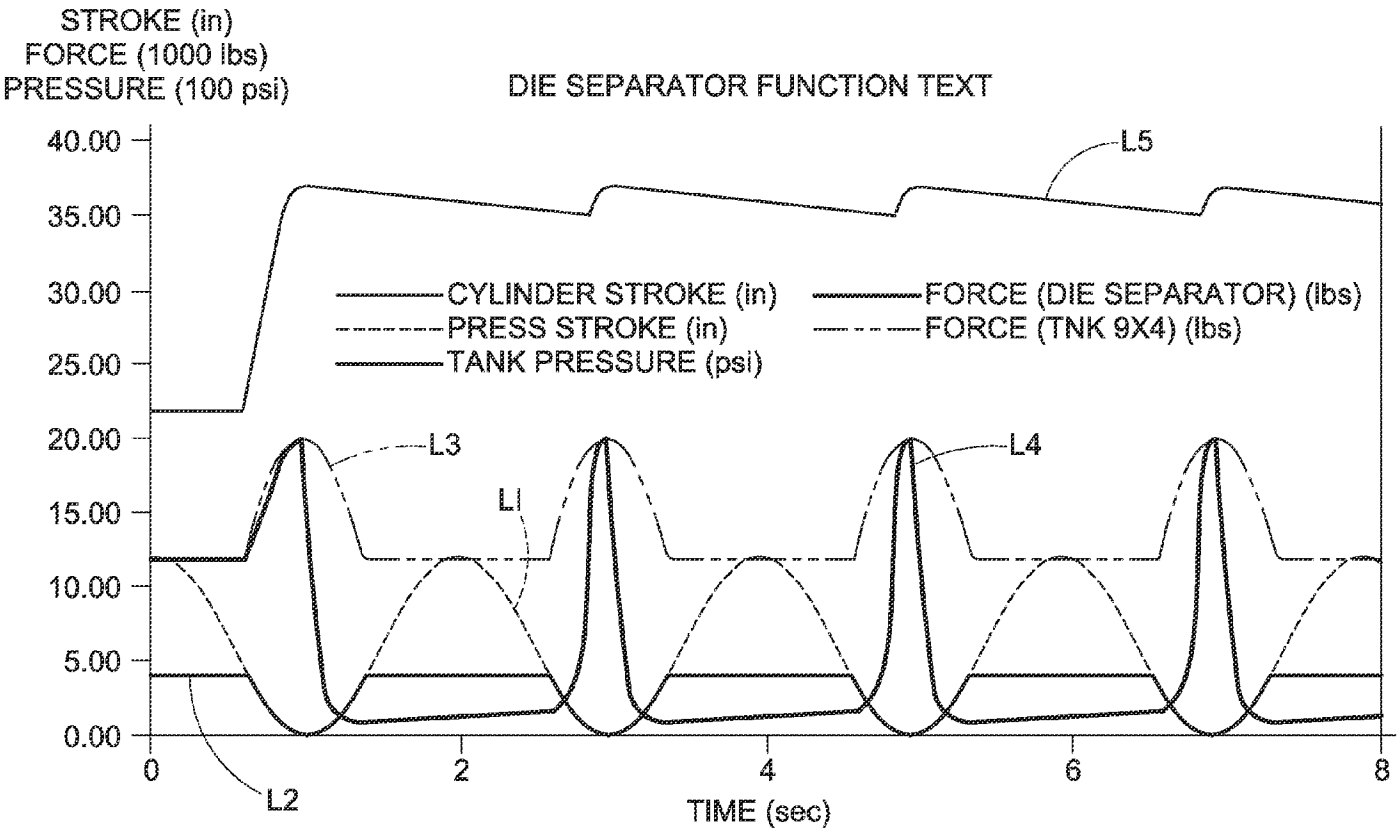

FIG. 7 is a graph that further illustrates operation of a die separation cylinder formed in accordance with the present development, such as the cylinder 10 or 10'. A press opens and closes in a cyclic fashion as indicated by the line L1. The piston 17 and piston rod 18 of the die separation cylinder and of a conventional cylinder reciprocates between an extended position (about 4 inches extended in the present example) to a fully depressed/retracted position (about 0 inches extended in the present example) as indicated by the line L2 (note that the press movement line L1 and piston rod movement line L2 coincide for a portion of the press closing/opening cycle as expected when the press and acting on the piston rod). The line L3 illustrates the force exerted by the piston rod on the die set for a conventional nitrogen gas spring, wherein the force, in the present example, begins at about 12 thousand pounds when the piston rod is extended and moves up to 20 thousand pounds as the press closes and the piston is forced inward, for all cycles of the press over time. In contrast, the line L4 shows the force exerted by the piston rod 18 of die separator cylinder 10 formed in accordance with the present development in the die set. The line L4 shows that for the first cycle of the press, the force begins at the same 12 thousand pounds and moves up to 20 thousand pounds as with the prior art. After that, however, the bleed orifice 30 prevents the cylinder bore 16 from recharging with the displaced gas between the press cycles again, so that the resistance force exerted by the piston rod 18 for the next and subsequent cycles of the press begins at about 1000 pounds and builds back to 20 thousand pounds only as the piston rod 18 is moved fully inward again by the press. The line L4 also shows that the force quickly drops to about 1000 pounds again as the press starts to open. Finally, the line L5 shows the gas pressure in the gas-containment space 14. The line L5 shows that after the initial stroke of the piston 17 and piston rod 18, the displaced gas raises the pressure in the gas-containment space and the bleed orifice 30 allows only a small decrease in pressure as the press open and recycles. In one embodiment, the full inward stroke of the piston 17 from the fully extended position to the fully depressed position is less than 10 seconds (e.g., 1 second as shown), while the bleed orifice 30 allows for equilibrium to be reached between the volumes 16,14 only after a time period of more than 1 minute, preferably 2 to 10 minutes of inactivity of the cylinder 10.

As noted above, the nitrogen or other inert gas is charged into the space 14 through a fill fitting 14*f* and fill passage 14*g*. The cylinder 10 is depressurized using the same path by venting the gas 14 from the gas-containment space 14 via path 14*g* and fitting 14*f*. Those of ordinary skill in the art will recognize that charging the bore 16 via space 14 lengthens the charge fill time because the bore 16 must fill via bleed passage 30. This structure is deemed to increase safety, however, because allowing gas discharge directly from the bore 16 via fitting 14*f* or another path could result in gas pressure being contained in the gas-containment space 14 without a technician being aware of same due to the restricted bleed passage 30, i.e., a technician could push the piston rod 18 inward and think the cylinder 10 has been depressurized even if high-pressure gas is still contained in the gas-containment space 14. In this case, the technician might attempt disassemble the cylinder while the gas-containment space 14 remains pressurized.

The invention has been described with reference to a preferred embodiment. Modifications and alterations will occur to those of ordinary skill in the art upon reading this specification. It is intended that the claims be construed literally and/or according to the doctrine of equivalents as including all such modifications and alterations.

The invention claimed is:

1. A die separator cylinder for use in separating first and second portions of a metal forming die set, said die separator cylinder comprising:

a housing comprising a bore and a gas-containment space;

a piston that is adapted to reciprocate in said bore between an extended position and a depressed position;

a bore outflow path for flow of gas from said bore to said gas-containment space, said bore outflow path comprising at least one check valve operatively located between said bore and said gas-containment space, said check valve allowing flow of gas from said bore to said gas-containment space when said piston moves inward in said bore toward said depressed position and restricting flow of gas from said gas-containment space to said bore when said piston moves outward in said bore from said depressed position toward said extended position;

a restricted bore inflow path that fluidically connects said bore and said gas-containment space, wherein said restricted bore inflow path permits flow of gas from said gas-containment space to said bore when gas pressure in said gas-containment space exceeds gas pressure in said bore;

wherein said bore outflow path and said bore inflow path define asymmetrical gas flow rates relative to each other so that said when said bore is charged with an inert gas, said inert gas biases said piston to said extended position with a force that varies depending upon an elapsed time interval after said piston moves from said depressed position to said extended position.

2. The die separator cylinder as set forth in claim 1, wherein said housing comprises an outer housing and an inner wall located in said outer housing, said inner wall defining said bore, wherein said gas-containment space is defined between said outer housing and said inner wall;

and wherein delays gas pressure equilibrium between said gas-containment space and said bore by at least 2 minutes after said piston is moved to said extended position.

3. The die separator cylinder as set forth in claim 2, wherein said restricted bore inflow path comprises an orifice that defines a gas flow path between said gas-containment space and said bore.

4. The die separator cylinder as set forth in claim 3, further comprising a wire located in said orifice to restrict gas flow through said orifice.

5. The die separator cylinder as set forth in claim 1, wherein said check valve comprises an O-ring seated in an annular groove, wherein said bore outflow path extends between said bore and said annular groove.

6. The die separator cylinder as set forth in claim 2, further comprising:

a base connected to said outer housing, said base closing a first open end of the outer housing;

a delay plug connected to said base and sealingly engaged with said inner wall, wherein a passage is defined between said delay plug and said base and wherein said gas-containment space is in fluid communication with said passage;

wherein said inner wall is sealingly engaged to said delay plug and wherein said check valve is installed in said delay plug and allows for gas flow from said bore to said passage.

7. The die separator cylinder as set forth in claim 6, wherein said restricted bore inflow path comprises an orifice that extends through said delay plug from said bore to said passage.

8. The die separator cylinder as set forth in claim 7, wherein said passage comprises an annular passage defined between said delay plug and said base.

9. The die separator cylinder as set forth in claim 8, wherein said delay plug is secured to said base by at least one fastener including a head located in a counterbore defined in said delay plug, and wherein said orifice extends between said passage and said counterbore.

10. The die separator cylinder as set forth in claim 9, further comprising a wire located in said orifice, wherein said wire includes a bent portion trapped in said counterbore by said fastener.

11. The die separator cylinder as set forth in claim 1, further comprising a rod connected to said piston and projecting outwardly from said housing.

12. A method for operating a pressurized gas cylinder in a metal forming die set, said method comprising:

securing a body of a pressurized gas cylinder to a first portion of a metal forming die set;

biasing a piston of said pressurized gas cylinder to an extended position in a bore of said body by pressurized gas contained in said bore so that a piston rod connected to said piston projects outwardly away from said cylinder body;

applying a force to said piston rod with a second portion of said metal forming die set to move said piston from said extended position in said bore to a depressed position in said bore, wherein gas is displaced from said bore to a gas-containment space by way of a bore outflow path in a first time period when said piston moves from said extended position in said bore to said depressed position, wherein gas-pressure in both said gas-containment space and said bore increases when said piston moves from said extended position to said depressed position;

removing said force to allow said piston to move from said depressed position in said bore to said extended position in said bore in response to gas pressure remaining in said bore;

during and for a second time period after movement of said piston from said depressed position to said extended position, flowing gas from said gas-containment space to said bore by way of a bore inflow path so that equilibrium pressure is reached between said bore and said gas-containment space after said second time period, wherein said bore inflow path is restricted as compared to said bore outflow path so that said second time period to reach equilibrium is longer than said first time period.

13. The method of claim 12, wherein said first time period is less than 10 seconds and said second time period is greater than 2 minutes.

14. The method of claim 13, wherein said bore outflow path comprises a check valve and wherein said gas is displaced from said bore to said gas-containment space through said check valve, said check valve restricts or fully blocks flow of gas from said gas-containment space to said bore via said bore outflow path.

15. The method of claim 14, wherein said step of flowing gas from said gas-containment space to said bore by way of a bore inflow path comprises flowing gas through an orifice comprising an occlusion.

16. The method of claim 15, wherein said occlusion comprises a wire located in said orifice.

17. The method as set forth in claim 12, wherein said gas biases said piston to said extended position with a biasing force that is less during said second time period as compared to after expiration of said second time period.

18. The die separator cylinder as set forth in claim 1, wherein said inert gas biases said piston to said extended position with a force that is greater when pressure equilibrium exists between said gas-containment space and said bore as compared to when gas pressure in said gas-containment space is greater than gas pressure in said bore.

* * * * *